US010389025B2

(12) United States Patent
An et al.

(10) Patent No.: US 10,389,025 B2
(45) Date of Patent: Aug. 20, 2019

(54) METAL BODY ANTENNA HAVING LOOP TYPE RADIATION ELEMENTS

(71) Applicant: ACE TECHNOLOGIES CORPORATION, Incheon (KR)

(72) Inventors: Sung Nam An, Seoul (KR); Won Whi Jin, Bucheon-si (KR); Jun Hee Kim, Incheon (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 259 days.

(21) Appl. No.: 15/454,002

(22) Filed: Mar. 9, 2017

(65) Prior Publication Data

US 2017/0279199 A1 Sep. 28, 2017

(30) Foreign Application Priority Data

Mar. 23, 2016 (KR) ..... 10-2016-0034362

(51) Int. Cl.

| | |
|---|---|
| ***H01Q 1/24*** | (2006.01) |
| ***H01Q 7/00*** | (2006.01) |
| ***H01Q 21/28*** | (2006.01) |
| ***H01Q 5/335*** | (2015.01) |

(52) U.S. Cl.

CPC ..... *H01Q 7/00* (2013.01); *H01Q 1/243* (2013.01); *H01Q 5/335* (2015.01); *H01Q 21/28* (2013.01)

(58) Field of Classification Search

CPC ..... H01Q 1/243; H01Q 7/00; H01Q 21/28

See application file for complete search history.

(56) References Cited

U.S. PATENT DOCUMENTS

2014/0078008 A1* 3/2014 Kang ..... H01Q 5/35 343/702
2015/0123871 A1* 5/2015 Chang ..... H01Q 1/243 343/872
2017/0338545 A1* 11/2017 Guo ..... H01Q 1/243

FOREIGN PATENT DOCUMENTS

| | | | |
|---|---|---|---|
| KR | 10-2009-0086255 | A | 8/2009 |
| KR | 10-2012-0094505 | A | 8/2012 |
| KR | 10-1284442 | B1 | 7/2013 |
| KR | 10-1609542 | B1 | 4/2016 |

* cited by examiner

*Primary Examiner* — Robert Karacsony
(74) *Attorney, Agent, or Firm* — LRK Patent Law Firm

(57) ABSTRACT

A metal body antenna having loop type radiation elements in which a housing unit is used as an antenna includes a radiation element supplied with a signal from a feeding power port, a ground coupled to the radiation element by loop coupling and in which an induction current is generated, and a frame bezel unit having an open end part separated from the ground by a dielectric and a gap. The frame bezel unit having the open end part supplied with an electric current induced into the ground is connected, and the metal body antenna operates in a wideband in multiple bands having an electrical length of a half wavelength. Accordingly, the bezel unit of a frame unit is effectively used and all of the Penta bands (i.e., GSM850, EGSM, DCS, PCS, and W2100) used in mobile phones is satisfied through a wideband multi-antenna structure having a small radiation loss.

20 Claims, 9 Drawing Sheets

METAL BODY ANTENNA HAVING LOOP TYPE RADIATION ELEMENTS

CROSS-REFERENCE TO RELATED APPLICATION

This application claims priority to Korean patent application number 10-2016-0034362, filed Mar. 23, 2016, the entire disclosure of which is incorporated by reference herein.

BACKGROUND OF THE INVENTION

1. Field of the Invention

The present invention relates to a metal body antenna having loop type radiation elements which operates in a wideband in multiple bands and, more particularly, to a metal body antenna including the housing unit of a terminal and loop type radiation elements having a wideband characteristic in multiple bands, wherein the end part of the radiation element supplied with a signal from a feeding power port formed in the housing unit is connected to a ground and the applied signal is connected to the ground by loop coupling.

2. Description of Related Art

With the recent rapid development of a communication technology, the size and weight of a communication device are reduced and performance of a communication device is further increased.

In particular, most of smart phones are rapidly evolving from the existing second-generation and third-generation communication methods, such as global system for mobile communication (GSM), code division multiple access (CDMA), and wideband CDMA (WCDMA), to a fourth-generation communication method, such as long term evolution (LTE). Furthermore, various technologies, such as Bluetooth, global positioning system (GPS), and Wi-Fi, are integrated.

A single mobile communication terminal may use a plurality of antennas to support various communication methods, but a wideband (or broadband) antenna technology capable of implementing multiple bands using a single antenna has been developed because there is a difficulty in disposing the plurality of antennas within the limited size of the terminal.

The wideband antenna technology has been proposed as a method for supporting various communication bands through the design of an antenna having a wide bandwidth. It is however impossible to improve efficiency of all of bands while implementing multiple bands based on a wide bandwidth. Furthermore, the space in various parts may be disposed is insufficient within the terminal because a wide space is required for the antenna design.

As a method for solving such a problem, a technology in which a housing unit forming an external appearance of a terminal is made of metal and the housing unit operates as an antenna was developed.

If the technology in which the housing unit operates as the antenna as described above is used, a space within the terminal can be additionally secured, more various parts can be disposed in the terminal using the additional space, and a thin type terminal design is made possible.

More specifically, antenna technologies using the housing unit as an antenna, that is, an antenna using a conductive bezel, and a metal battery cover has a disadvantage in that they have a narrow bandwidth. Accordingly, additional technologies, such as a tubable antenna technology in order to support various communication bands, have been additionally applied.

Furthermore, several problems, such as a rise of a production cost attributable to the application of the tubable antenna technologies, an increase of the design period attributable to added parts, and a rise of power consumption, are accompanied.

Accordingly, there is an urgent need for an antenna design technology which can utilize a space within the terminal as much as possible and achieve a smaller size and has a wide bandwidth even without using an additional technology by forming the casing of a housing unit forming an external appearance of the terminal using a metal material so that the housing unit operates as an antenna.

In order to solve such conventional problems, Korean Patent No. 10-1609542 entitled "Metal-Body Antenna to Operating Wideband in a Multi-Band" was proposed.

As the terminal tends to become slim, the PCB area of the terminal recently tends to be designed by avoiding parts, such as a speaker and a battery. In such a case, an extension cable is required because the feeding power port 8*a* of an existing antenna deviates from the area of a PCB 2*a* as shown in FIG. 1*a,* and there is a difficulty in the antenna design. In order to supplement such a disadvantage, there is a need for an antenna design in which a feeding power port 8*b* shown in FIG. 1*b* is disposed within the area of a PCB 2*b.*

SUMMARY OF THE INVENTION

In accordance with an embodiment of the present invention, an object of the present invention is to provide a metal body antenna having loop type radiation elements, which has a small radiation loss and shows a wideband characteristic in multiple bands using a frame bezel unit.

In accordance with another embodiment of the present invention, another object of the present invention is to provide an antenna having loop type radiation elements and showing a wideband characteristic in multiple bands, wherein a radiation element supplied with a signal from a feeding power port is connected to a ground in a loop form without having a coupling structure in which the radiation element supplied with a signal from the feeding power port is coupled to a frame bezel unit as a radiation element connected to the ground.

In accordance with another embodiment of the present invention, an object of the present invention is to provide a metal body antenna having loop type radiation elements and showing a wideband characteristic in multiple bands, wherein when an electromagnetic signal is applied to a feeding power port, a radiation element is coupled to a ground by loop coupling to generate an induction current in the ground, electric energy is concentrated on the end part of an upper bezel unit due to a surface current flowing into a frame bezel unit as a radiation element connected to the ground due to an electric current induced into the ground, and magnetic energy is concentrated near a connection point that connects a side bezel unit and the ground.

In accordance with another embodiment of the present invention, another object of the present invention is to provide a metal body antenna having loop type radiation elements and showing a wideband characteristic in multiple bands, wherein an L-C element is inserted to a feeding power port and perfect impedance matching with the antenna unit is performed in an operating frequency band.

In a metal body antenna having loop type radiation elements in accordance with an embodiment of the present invention, a radiation element supplied with a signal from a feeding power port does not have a coupling structure along with a frame bezel unit as a radiation element connected to a ground, but a radiation element supplied with a signal from a feeding power port is coupled to a ground by loop coupling and operates in a wideband in multiple bands.

In accordance with another embodiment of the present invention, a metal body antenna having loop type radiation elements and operating in a wideband in multiple bands includes a housing unit adapted to form an external appearance of a terminal; a first antenna unit adapted to include a first radiation element supplied with an electromagnetic signal from a first feeding power port formed in the housing unit, a ground coupled to the first radiation element by loop coupling and formed in the housing unit in which an induction current is generated, a side bezel unit connected to the ground, and an upper bezel unit connected to the side bezel unit and having an end part open by a gap; and a second antenna unit adapted to include a second radiation element supplied with an electromagnetic signal from a second feeding power port formed in the housing unit, a ground coupled to the second radiation element by loop coupling and formed in the housing unit in which an induction current is generated, a side bezel unit connected to the ground, and an upper bezel unit connected to the side bezel unit and having an end part open by a gap.

In accordance with another embodiment of the present invention, a metal body antenna having loop type radiation elements includes first and second radiation elements supplied with signals from feeding power ports; a ground coupled to the first and the second radiation elements by loop coupling, an induction current being generated in the ground; a bezel unit separated by the ground and a dielectric; side bezel units of the bezel unit supplied with the induction current of the ground; and an upper bezel unit connected to the side bezel units and having end parts open by gaps formed in an upper frame, wherein the first and second antenna units operate in a wideband in multiple bands having an electrical length of a half wavelength.

In accordance with another embodiment of the present invention, a metal body antenna having loop type radiation elements and operating in a wideband in multiple bands, wherein the metal body antenna includes a rectangular ground surface made of a metal material and an upper frame bezel unit made of a metal material and surrounding an outermost edge part of the rectangular ground surface, the metal body antenna being formed in a housing unit of a terminal and including a dielectric formed in a specific width between the rectangular ground surface and the upper frame bezel unit; gaps each formed to maintain a specific opening at a specific portion of the upper frame bezel unit of the housing unit; a first antenna unit adapted to include a first feeding power port which is a first port formed in a specific portion adjacent to the dielectric above the ground surface, a first radiation element connected to the first feeding power port, and supplied with an electromagnetic signal, and having an end part disconnected at a specific height with respect to the ground surface, a ground coupled to the first radiation element by loop coupling, supplied with an electromagnetic signal to generate an induction current, and formed below the first radiation element, a side bezel unit of the upper frame bezel unit connected to the ground by a connection point and separated by the dielectric, and an upper bezel unit connected to the side bezel unit and having an end part by the gap; and a second antenna unit adapted to include a second feeding power port which is a second port formed in a specific portion adjacent to the dielectric above the ground surface, a second radiation element connected to the second feeding power port, and supplied with an electromagnetic signal, and having an end part disconnected at a specific height with respect to the ground surface, a ground coupled to the second radiation element by loop coupling, supplied with an electromagnetic signal to generate an induction current, and formed below the second radiation element, a side bezel unit of the upper frame bezel unit connected to the ground by a connection point and separated by the dielectric, and an upper bezel unit connected to the side bezel unit and having an end part by the gap.

In accordance with another embodiment of the present invention, a metal body antenna having loop type radiation elements and operating in a wideband in multiple bands includes a housing unit adapted to form an external appearance of a terminal; a first antenna unit adapted to include a first radiation element supplied with an electromagnetic signal from a first feeding power port formed in the housing unit, a ground coupled to the first radiation element by loop coupling and formed in the housing unit in which an induction current is generated, a side bezel unit connected to the ground, and an upper bezel unit connected to the side bezel unit and having an end part open by a gap; and a second antenna unit adapted to include a second radiation element supplied with an electromagnetic signal from a second feeding power port formed in the housing unit, a ground coupled to the second radiation element by loop coupling and formed in the housing unit in which an induction current is generated, a side bezel unit connected to the ground, and an upper bezel unit connected to the side bezel unit and having an end part open by a gap.

DETAILED DESCRIPTION OF THE EMBODIMENTS

Figure 1A:
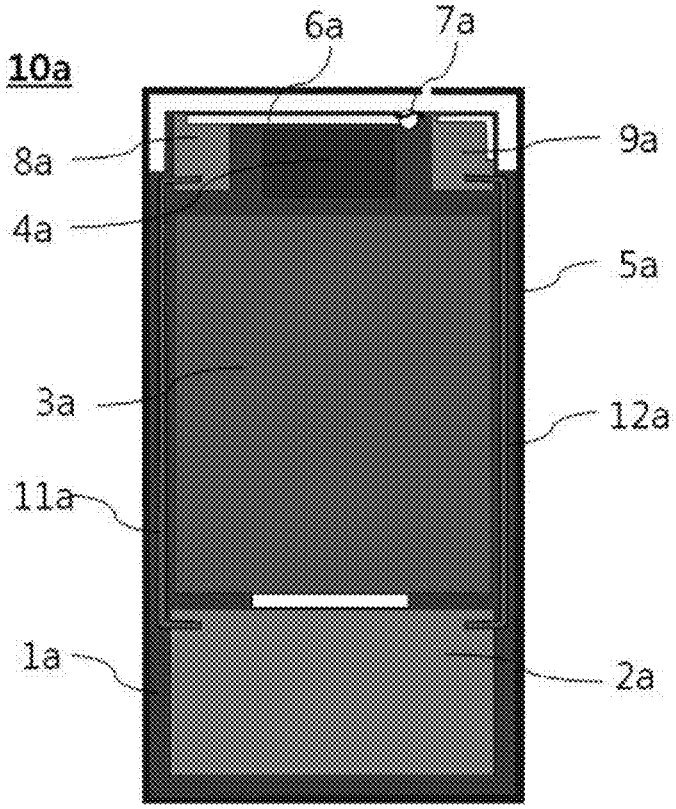
FIG. 1A RELATED ART
FIG. 1*a* is a case where a radiation element according to a conventional technology is a monopole type and shows the configuration of parts of a mobile terminal.

Hereinafter, embodiments of the present invention will be described in detail with reference to the accompanying drawings. The same elements are assigned the same reference numerals. Repeated descriptions and descriptions of known functions and configurations which have been deemed to make the gist of the present invention unnecessarily obscure will be omitted below. The embodiments of the present invention are intended to fully describe the present invention to a person having ordinary knowledge in the art to which the present invention pertains. Accordingly, the shapes, sizes, etc. of components in the drawings may be exaggerated to make the description clear.

Embodiments of a metal body antenna are described in detail below with reference to the accompanying drawings.

Figure 2:
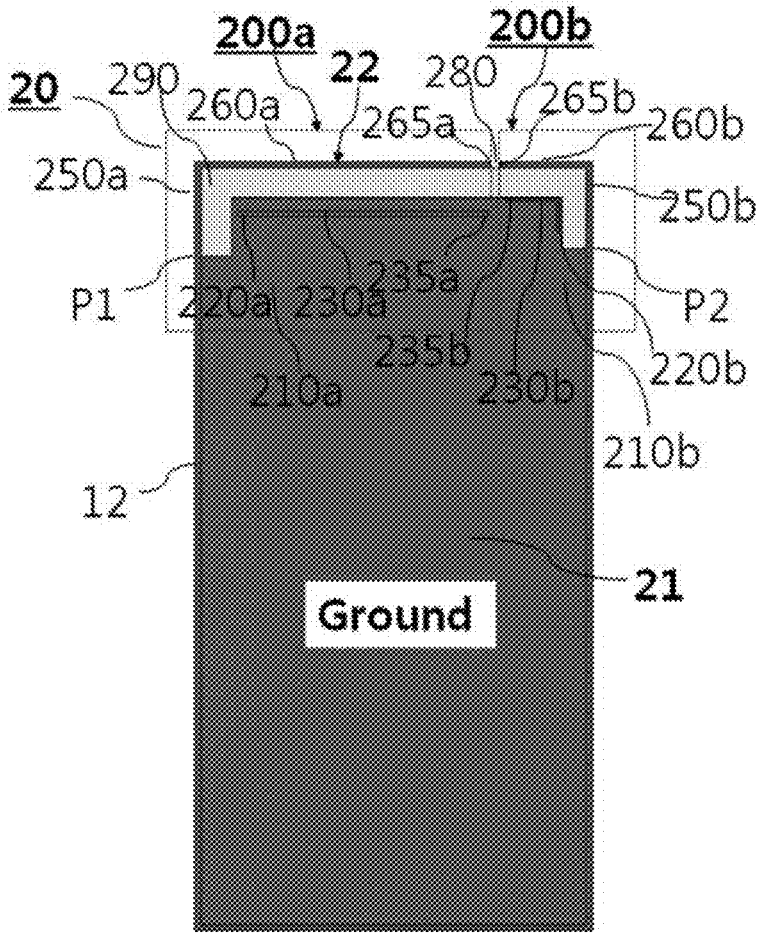
FIG. 2 is a plan view showing a representative structure of a metal body antenna having loop type radiation elements formed in the housing unit of the terminal in accordance with an embodiment of the present invention.

FIG. 1*a* is a case where a radiation element according to a conventional technology is a monopole type and shows the configuration of parts of a mobile terminal. FIG. 2 is a plan view showing a representative structure of a metal body antenna having loop type radiation elements formed in the housing unit of the terminal in accordance with an embodiment of the present invention.

Figure 1B:
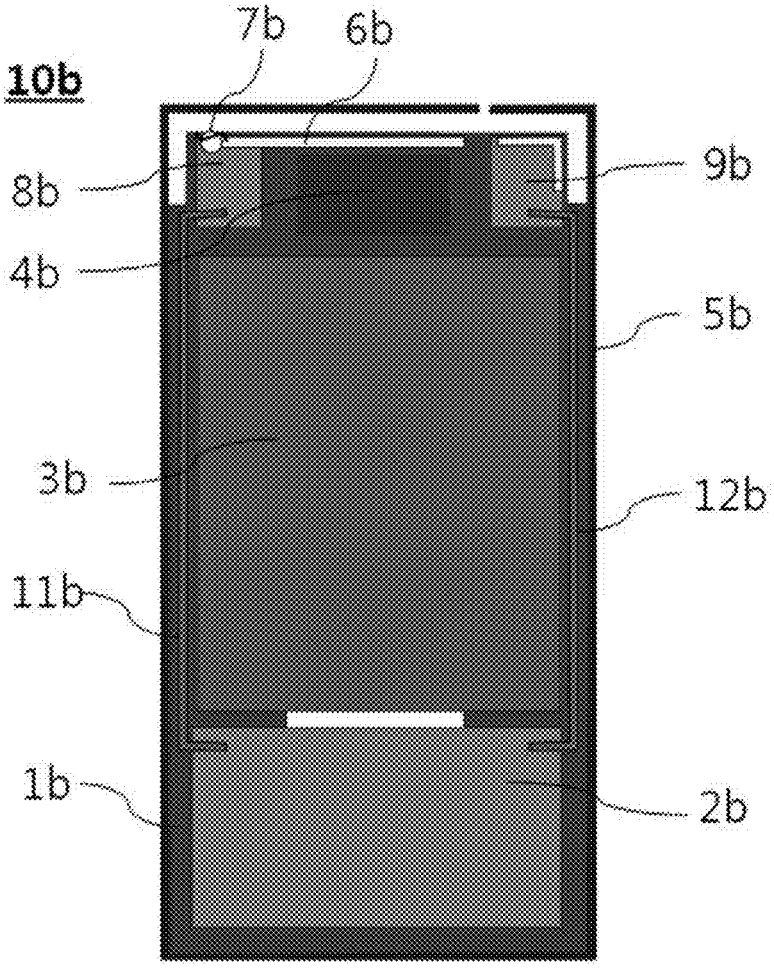
FIG. 1*b* is a case where a radiation element according to an embodiment of the present invention is a loop type and shows the configuration of parts of a mobile terminal.

Referring to FIGS. 1*b* and 2, the metal body antenna having loop type radiation elements according to an embodiment of the present invention is mounted on the housing unit 20 of a terminal. The housing unit 20 includes a rectangular ground 21 made of a metal material and formed to occupy most of the area of the housing unit 20 and a frame bezel unit 22 on the upper side made of a metal material and formed to surround the outermost edge part of the rectangular ground.

The ground 21 of the housing unit 20 provides a ground voltage within the terminal and may form a board on which circuit elements and parts necessary for the operation of the terminal are mounted.

More specifically, referring to FIG. 2, the metal body antenna formed in the housing unit 20 according to an embodiment of the present invention includes grounds 210*a* and 210*b* of a ground region on the upper side indicated by dotted lines, first and second feeding power ports 220*a* and 220*b* including two ports, two first and second radiation elements 230*a* and 230*b*, a side bezel unit 250 of a side part frame, that is, first and second side bezel units 250*a* and 250*b* formed in the side frame bezel unit 250 in the upper frame bezel unit 22 of an edge part in the upper outermost part of the rectangular ground of the housing unit, first and second bezel units 260*a* and 260*b* formed in the upper bezel unit 260 of the upper frame bezel unit 22, and a gap 280 and dielectric 290 formed in the first and the second bezel units 260*a* and 260*b*.

Furthermore, the metal body antenna configured to have loop type radiation elements and formed in the housing unit 20 according to an embodiment of the present invention includes a first antenna unit 200*a* operating in a low frequency band and a second antenna unit 200*b* operating in a high frequency band.

That is, in accordance with an embodiment of the present invention, each of the first and the second antenna units 200*a* and 200*b* is an antenna having an electrical length of a half wavelength. That is, the metal body antenna according to an embodiment of the present invention is formed dually or solely like the first antenna unit 200*a* and the second antenna unit 200*b*. The first antenna unit 200*a* operates in a low frequency band and the second antenna unit 200*b* operates in a high frequency band, and thus the metal body antenna operates in a wideband in multiple bands. The first antenna unit 200*a* operates at 824 MHz~960 MHz, that is, a frequency of GSM850 and EGSM of a low frequency band. The second antenna unit 200*b* operates at 1710 MHz~2170 MHz, that is, a frequency of DCS, PCS or W2100 of a high frequency band.

The first antenna unit 200*a* includes the ground 210*a*, the first feeding power port 220*a*, the first radiation element 230*a*, the first side bezel unit 250*a*, the first bezel unit 260*a*, the gap 280, and the dielectric 290 in the upper ground region indicated by the dotted lines. Accordingly, the first antenna unit 200*a* is formed so that the end part 265*a* of the first bezel unit 260*a* is opened by the gap 280.

Furthermore, the second antenna unit 200*b* includes the ground 210*b*, the second feeding power port 220*b*, the second radiation element 230*b*, the second side bezel unit 250*b*, the second bezel unit 260*b*, the gap 280, and the dielectric 290 in the upper ground region indicated by the dotted lines. Accordingly, the second antenna unit 200*b* is formed so that the end part 265*b* of the second bezel unit 260*b* is open by the gap 280.

The two first and the second feeding power ports 220*a* and 220*b* are formed to be not connected to the grounds 210*a* and 210*b* of the upper ground region indicated by the dotted lines, that is, the ground 21 on the upper side which neighbors the dielectric 290, and thus function to supply an electromagnetic signal from the RF module of a terminal to the first and the second antenna units 200*a* and 200*b*.

Furthermore, in some embodiments, L-C elements are inserted into the first and the second feeding power ports 220*a* and 220*b*, respectively, so that the first and the second feeding power ports 220*a* and 220*b* are perfectly matched with the first and the second antenna units 200*a* and 200*b* in respective operating frequency bands, thereby achieving impedance matching.

The first radiation element 230*a* is connected to the first feeding power port 220*a* and supplied with an electromagnetic signal. The first radiation element 230*a* has a specific height and length with respect to the ground 210*a* and is configured to have an end part 235*a* disconnected.

The second radiation element 230*b* is connected to the second feeding power port 220*b* and supplied with an electromagnetic signal. The second radiation element 230*b* has a specific height and length with respect to the ground 210*b* and is configured to have an end part 235*b* disconnected.

The first and the second radiation elements 230*a* and 230*b* may be formed above the ground 21 or the dielectric 290 in order to utilize the space of the housing unit 20.

Accordingly, the first and the second radiation elements 230*a* and 230*b* supplied with electromagnetic signals from the first and the second feeding power ports 220*a* and 220*b* transfer the electromagnetic signals to the grounds 210*a* and 210*b* by loop coupling.

The first and the second side bezel units 250*a* and 250*b* are formed in the left and right surfaces of the frame bezel unit 22 in the outermost edge part of the housing unit. The first and the second side bezel units 250*a* and 250*b* are connected to the grounds 210*a* and 210*b* to which an electromagnetic signal from the radiation elements 230*a* and 230*b* is supplied at connection points P1 and P2 by loop coupling, and transfer the electromagnetic signal to the first and the second bezel units 260*a* and 260*b* of the first and the second antenna units 200*a* and 200*b*.

Accordingly, the first and the second radiation elements 230*a* and 230*b* are formed on both sides of grounds 210*a* and 210*b* based on the connection points P1 and P2, respectively, and operate in a wideband in multiple bands.

Furthermore, the upper bezel unit 260 is connected to the first and the second side bezel units 250*a* and 250*b* and is the upper bezel unit 260 of the upper frame bezel unit 22 in the upper outermost edge part of the housing unit 20. The upper bezel unit 260 includes the first bezel unit 260*a* on the upper left side of the first antenna unit 200*a* and the second bezel unit 260*b* on the upper right side of the second antenna unit 200*b*.

In the case of the first antenna unit 200*a*, the first bezel unit 260*a* is horizontally formed on the upper part as the upper bezel unit 260 of the frame bezel unit 22 extended to the end corner part of the first side bezel unit 250*a* of the left surface. In the case of the second antenna unit 200*b*, the second bezel unit 260*b* is horizontally formed on the upper part as upper bezel unit 260 of the frame bezel unit 22 extended to the end corner part of the second side bezel unit 250*b* of the right surface.

The gap 280 is formed to maintain a specific opening at a specific location of the upper bezel unit 260 so that the first and the second bezel units 260*a* and 260*b* are separated. Accordingly, the open end parts 265*a* and 265*b* are formed in the first and the second bezel units 260*a* and 260*b*, respectively.

The dielectric 290 formed to have a specific width is provided between the rectangular ground 21 and the upper frame bezel unit 22 including the first and the second side bezel units 250*a* and 250*b* connected to the first and the first bezel units 260*a* and 260*b* by the gap 280.

Accordingly, the upper frame bezel unit 22, including the first and the second side bezel units 250*a* and 250*b* of the bezel unit 250 of the side unit and the first and the second bezel units 260*a* and 260*b* of the upper bezel unit 260, is separated from the ground 21 by the gap 280 and the dielectric 290.

Figure 3A:
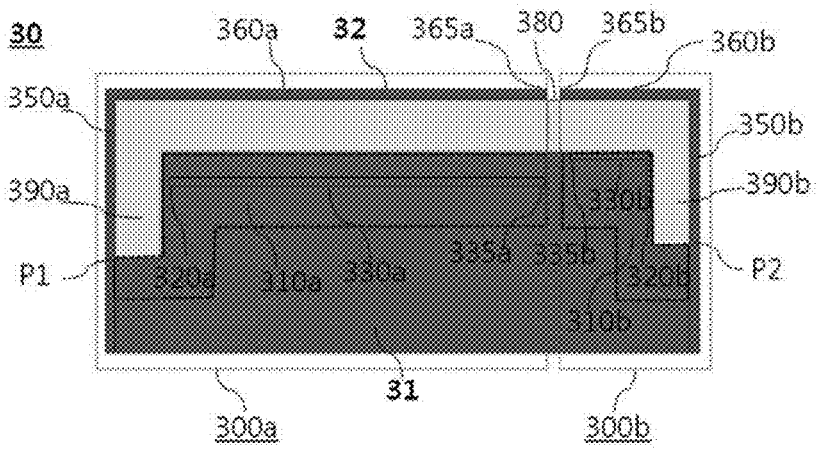
FIG. 3*a* is a case where the radiation element connected to a feeding power port is linear in FIG. 2 and is a detailed plan view showing an enlarged structure of the metal body antenna having loop type radiation elements.
Figure 3B:
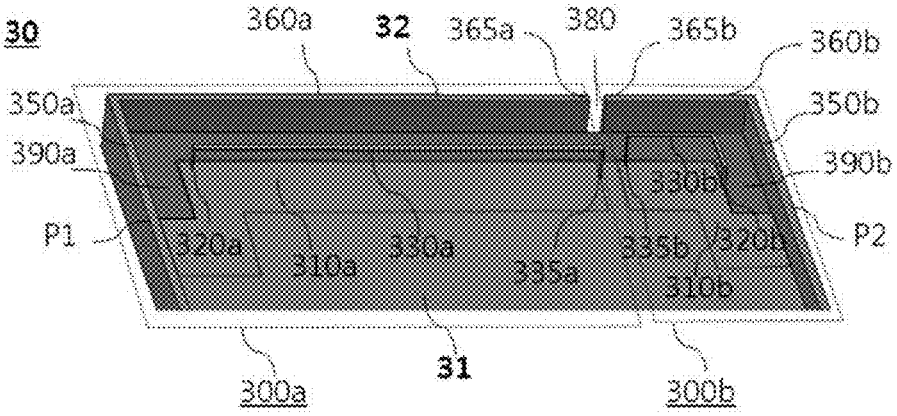
FIG. 3*b* is a case where the radiation element connected to the feeding power port is linear in FIG. 2 and is a detailed perspective view showing an enlarged structure of the metal body antenna having loop type radiation elements.

FIG. 3*a* is a case where the radiation element connected to the feeding power port is linear in FIG. 2 and is a detailed plan view showing an enlarged structure of the metal body antenna having loop type radiation elements. FIG. 3*b* is a case where the radiation element connected to the feeding power port is linear in FIG. 2 and is a detailed perspective view showing an enlarged structure of the metal body antenna having loop type radiation elements.

The metal body antenna having loop type radiation elements according to an embodiment of the present invention is described in detail with reference to FIGS. 2, 3*a*, and 3*b*.

The metal body antenna formed in the housing unit 20 having loop type radiation elements according to an embodiment of the present invention includes the grounds 210*a* and 210*b* of the upper ground region indicated by the dotted lines, the first and the second feeding power ports 220*a* and 220*b* including two ports, the two first and the second radiation elements 230*a* and 230*b*, the side bezel unit 250 of a side part frame, that is, the first and the second side bezel units 250*a* and 250*b* formed in the side frame bezel unit 250 of the upper frame bezel unit 22 at the edge parts of the upper outermost part of the rectangular ground of the housing unit, the first and the second bezel units 260*a* and 260*b* formed in the upper bezel unit 260 of the upper frame bezel unit 22, and the gap 280 and the dielectric 290 formed in the first and the second bezel units 260*a* and 260*b*.

In accordance with an embodiment of the present invention, FIG. 3*a* relates to a metal body antenna having a linear structure in which the first and the second radiation elements 330*a* and 330*b* are radiation elements connected to the feeding power ports in FIG. 2. Accordingly, in some embodiments, the first and the second radiation elements 330*a* and 330*b* in the structure of FIGS. 3*a* and 3*b* are also called first and second linear radiation elements 330*a* and 330*b*.

The metal body antenna formed in the housing unit 30, having loop type radiation elements, according to an embodiment of the present invention includes a first antenna unit 300*a* operating in a low frequency band and a second antenna unit 300*b* operating in a high frequency band.

That is, in accordance with an embodiment of the present invention, each of the first and the second antenna units 300*a* and 300*b* is an antenna having an electrical length of a half wavelength. The metal body antenna according to an embodiment of the present invention is formed dually or solely like the first antenna unit 300*a* and the second antenna unit 300*b*. The first antenna unit 300*a* operates in a low frequency band and the second antenna unit 300*b* operates in a high frequency band, thus operating in a wideband in multiple bands. The first antenna unit 300*a* operates at 824 MHz~960 MHz, that is, a frequency of GSM850 and EGSM of a low frequency band. The second antenna unit 300*b* operates at 1710 MHz~2170 MHz, that is, a frequency of DCS, PCS or W2100 of a high frequency band.

In the metal body antenna of FIGS. 3*a* and 3*b* according to an embodiment of the present invention, first and second radiation elements 330*a* and 330*b* have a linear structure, and the end parts 365*a* and 265*b* of a first bezel unit 360*a* and a second bezel unit 360*b* are adjacent to each other with a gap 380 interposed therebetween.

The configuration of the first antenna unit 300*a* is described below. The first antenna unit 300*a* operates in a low frequency band, and includes the first linear radiation element 330*a*, a ground 310*a*, that is, an upper ground region indicated by dotted lines, a first connection point P1, a first side bezel unit 350*a*, the first bezel unit 360*a*, the gap 380, and a dielectric 390*a*.

A first feeding power port 320*a* connected to the first linear radiation element 330*a* is located at a place close to the first connection point P1 and is formed to be not connected to the ground 310*a* at a specific portion of the ground 31 of the upper ground region which is adjacent to the dielectric 390*a* and indicated by the dotted lines. Accordingly, the first feeding power port 320*a* supplies an electromagnetic signal of a low frequency band from the RF module of a terminal to the first antenna unit 300*a*.

Furthermore, in some embodiments, an L-C element is inserted into the first feeding power port 320*a* so that perfect matching with the first antenna unit 300*a* is performed in a low frequency band, thereby achieving impedance matching.

The first linear radiation element 330*a* is connected to the first feeding power port 320*a* and supplied with an electromagnetic signal. The first linear radiation element 330*a* is linearly formed at a specific height with respect to the ground 310*a* on the upper side and is formed to have a disconnected end part 335*b*. Accordingly, when the first linear radiation element 330*a* supplied with the electromagnetic signal from the first feeding power port 320*a* transfers the electromagnetic signal to the ground 310*a* by loop coupling, an induction current is generated in the ground 310*a*. The end part 335*a* of the disconnected first linear radiation element 330*a* is located at a point close to the end part 365*a* of the first bezel unit 360*a*.

The first radiation element 330*a* may be formed above the ground 310*a* or the dielectric 390*a* in order to utilize the space of the housing unit 30.

The first connection point P1 connects the ground 310*a* of the upper ground region indicated by the dotted lines and the first side bezel unit 350*a*, that is, the frame bezel unit 350 on the left surface of the upper frame bezel unit 32. The first connection point P1 connects the ground 310*a* and the first side bezel unit 350*a*.

Accordingly, an electromagnetic signal is transferred from the ground 310*a* to the first side bezel unit 350*a* of the first antenna unit 300*a* by the first connection point P1. The first connection point P1 becomes the start point of the first side bezel unit 350*a*.

Furthermore, the first side bezel unit 350*a* of the first antenna unit 300*a* transfers the electromagnetic signal, transferred by the first connection point P1, to the first bezel unit 360*a* of the upper frame bezel unit 32 which surrounds an edge part in the upper outermost part of the rectangular ground 31.

The first bezel unit 360*a* is connected to the end corner part of the first side bezel unit 350*a*, vertical to the first side bezel unit 350*a*, and horizontally formed on the upper part of the upper bezel unit 360 of the upper frame bezel unit 32. The open end part 365*a* is formed in the first bezel unit 360*a*.

The gap 380 is formed to maintain a gap at a specific location of the upper bezel unit 360, and forms the open end part 365*a* of the first bezel unit 360*a*.

The dielectric 390*a* formed to have a specific width is provided between the upper frame bezel unit 32 and the rectangular ground 31 separated by the gap 380.

That is, the frame bezel unit 32, including the first side bezel unit 350*a* of the side bezel unit 350 on the left surface and the first bezel unit 360*a* of the upper bezel unit 360, is separated from the ground 31 by the gap 380 and the dielectric 390*a*.

Accordingly, the first antenna unit 300*a* includes the first feeding power port 320*a*, that is, a first port formed to be not connected to the ground 310*a* of the upper ground region adjacent to the dielectric 390*a* and indicated by the dotted lines; the first linear radiation element 330*a* connected to the first feeding power port 320*a*, supplied with an electromagnetic signal, and formed to have the linearly disconnected end part 335*a* at a specific height with respect to the ground 310*a*; the ground 310*a* connected to the first linear radiation element 330*a* by loop coupling, supplied with an electromagnetic signal, and formed below the first linear radiation element 330*a* from which an induction current is generated; the first side bezel unit 350*a* of the bezel unit 350, that is, a side part of the frame bezel unit 32 connected to the ground 310*a* at the first connection point P1; and the open end part 365*a* of the first bezel unit 360*a*, that is, the left frame of the upper bezel unit 360 connected to the first side bezel unit 350*a*.

An operating principle according to the configuration of the first antenna unit 300*a* is described below.

When an electromagnetic signal is applied to the first feeding power port 320*a*, the first linear radiation element 330*a* is coupled to the ground 310*a* by loop coupling, and thus an induction current is generated in the ground 310*a*. An electric current induced into the ground 310*a* flows into the first bezel unit 360*a* through the first side bezel unit 350*a* by the first connection point P1. Electric energy is concentrated on the end part 365*a* of the first bezel unit 360*a* due to a flow of a surface current, and magnetic energy is concentrated around the first connection point P1 that connects the first side bezel unit 350*a* and the ground 310*a*. The first antenna unit 300*a* has an electrical length of a half wavelength in an operating frequency of a low frequency band and shows a wideband characteristic, such as a reflection loss 301 indicated by a solid line 301 in FIG. 3*c*.

The configuration of the second antenna unit 300*b* is described below. The second antenna unit 300*b* operates in a high frequency band, and includes the second linear radiation element 330*b*, the ground 310*b*, the second connection point P2, the second side bezel unit 350*b*, the second bezel unit 360*b*, the gap 380, and a dielectric 390*b*.

The second feeding power port 320*b* connected to the second linear radiation element 330*b* is located at a place close to the second connection point P2 and is formed to be not connected to the ground 310*b* of the upper ground region adjacent to the dielectric 390*b* and indicated by dotted lines. Accordingly, the second feeding power port 320*b* supplies an electromagnetic signal of a high frequency band from the RF module of a terminal to the second antenna unit 300*b*.

Furthermore, in some embodiments, an L-C element is inserted into the second feeding power port 320*b* so that perfect matching with the second antenna unit 300*b* is performed in a high frequency band, thereby achieving impedance matching.

The second linear radiation element 330*b* is connected to the second feeding power port 320*b*, supplied with an electromagnetic signal, and formed to have the linearly disconnected end part 335*b* at a specific height with respect to the ground 310*b* on the upper side. Accordingly, when the second linear radiation element 330*b* supplied with an electromagnetic signal from the second feeding power port 320*a* transfers the electromagnetic signal to the ground 310*a* by loop coupling, an induction current is generated in the ground 310*a*. The disconnected end part 335*b* of the second linear radiation element 330*b* is located at a place close to the end part 365*b* of the second bezel unit 360*b*.

The second radiation element 330*b* may be formed above the ground 310*b* or the dielectric 390*b* in order to utilize the space of the housing unit 30.

The second connection point P2 connects the ground 310*b* and the side bezel unit 350, that is, a side part frame of the upper frame bezel unit 32. The second connection point P2 connects the ground 310*b* and the second side bezel unit 250*b* on the right surface of the frame bezel unit 32.

Accordingly, an electromagnetic signal is transferred from the ground 310*b* to second side bezel unit 350*b* of the second antenna unit 300*b* by the second connection point P2. The second connection point P2 becomes the start point of the second side bezel unit 350*b*.

Furthermore, the second side bezel unit 350*b* of the second antenna unit 300*b* transfers the electromagnetic signal, transferred by the second connection point P2, to the second bezel unit 360*b* of the upper bezel unit 360 that surrounds the edge part of the upper outermost part of the rectangular ground 31.

The second bezel unit 360*b* is connected to the end corner part of the second side bezel unit 350*b*, vertical to the second side bezel unit 350*b*, and horizontally formed on the upper right side of the upper frame 360 of the upper frame bezel unit 32. The open end part 365*b* is formed in the second bezel unit 360*b*.

The gap 380 is formed to maintain a gap at a specific location of the upper bezel unit 360, and forms the open end part 365*b* of the second bezel unit 360*b*.

The dielectric 390*b* formed to have a specific width is provided between the upper frame bezel unit 32 and the rectangular ground 31 upward separated by the gap 380.

That is, the upper frame bezel unit 32, including the second side bezel unit 350*b* of the side bezel unit 350 of the right surface and the right second bezel unit 360*b* of the upper bezel unit 360, is separated from the ground 31 by the gap 380 and the dielectric 390*b*.

Accordingly, the second antenna unit 300*b* includes the second feeding power port 320*b*, that is, a second port formed to be not connected to the ground 310*b* at a specific portion on the upper part of the ground 310*b* adjacent to the dielectric 390*b*; the second linear radiation element 330*b* connected to the second feeding power port 320*b*, supplied with an electromagnetic signal, and equipped with the linearly disconnected end part 335*b* at a specific height with respect to the ground 310*b*; the ground 310*b* coupled to the second linear radiation element 330*b* by loop coupling, supplied with an electromagnetic signal, and formed below the second linear radiation element 330*b* from which an induction current is generated; the second side bezel unit 350*b* of the bezel unit 350 on the side part of the frame 32 connected to the ground 310*b* by the second connection point P2; and the disconnected end part 365*b* of the second bezel unit 360*b* of the upper bezel unit 360 connected to the second side bezel unit 350*b*, that is, the right frame of the second connection point P2.

Accordingly, the first and the second linear radiation elements 330*a* and 330*b* are formed on both sides of the grounds 310*a* and 310*b* based on the gap 380 and the first and the second connection points P1 and P2, and operate in a wideband in multiple bands.

An operating principle according to the configuration of the second antenna unit 300*b* is described below. When an electromagnetic signal is applied to the second feeding power port 320*b*, the second linear radiation element 330*b* is coupled to the ground 310*b* by loop coupling, and an induction current is generated in the ground 310*b*. An electric current induced into the ground 310*b* flows into the second bezel unit 360*b* through the second side bezel unit 350*b* by the second connection point P2. Electric energy is concentrated on the end part 365*b* of the second bezel unit 360*b* due to a flow of a surface current, and magnetic energy is concentrated around the second connection point P2 that connects the second side bezel unit 350*b* and the ground 310*b*. The second antenna unit 300*b* has an electrical length of a half wavelength in an operating frequency of a high frequency band, and shows a wideband characteristic, such as a reflection loss indicated by dotted lines 302 of FIG. 3*c*.

Figure 3C:
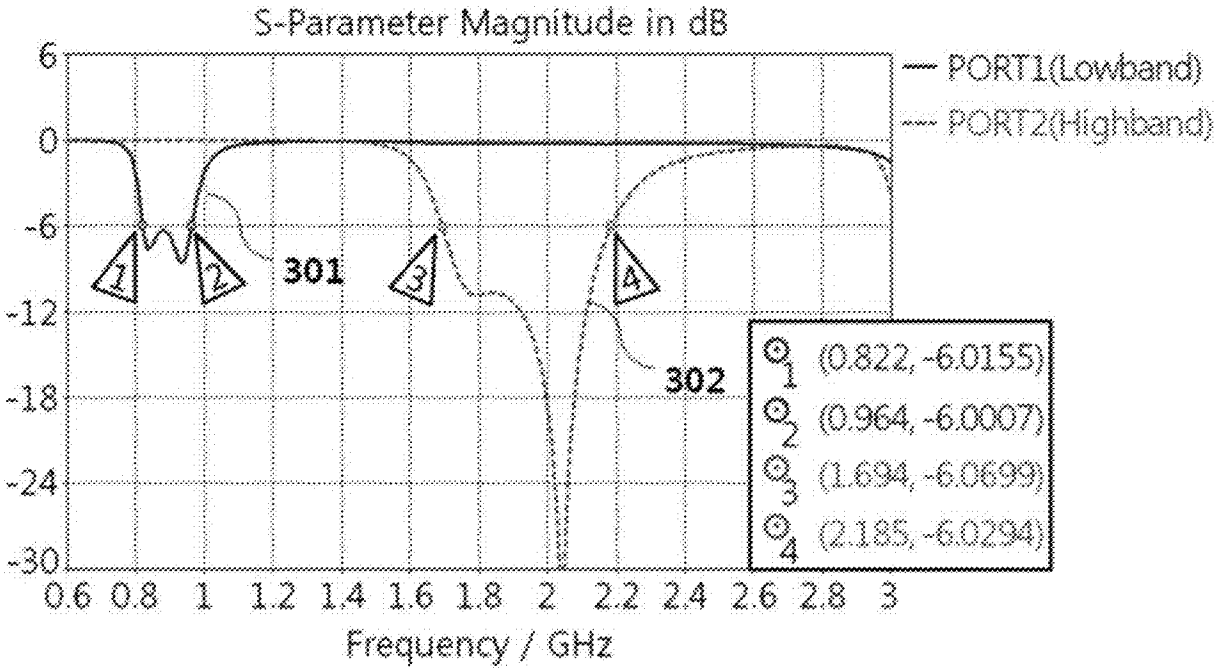
FIG. 3*c* is a case where the radiation element connected to the feeding power port is linear in FIGS. 3*a* and 3*b* and shows a reflection loss of the metal body antenna.

FIG. 3*c* is a diagram showing a reflection loss of the metal body antenna having loop type radiation elements shown in FIGS. 3*a* and 3*b*.

Referring to FIG. 3*c*, the range of an operating frequency in a low frequency band is from about 822 MHz to about 964 MHz based on a reflection loss −6 dB indicated by the solid line 301, and includes 824 MHz to 960 MHz, that is, the frequency section of GSM850 and EGSM. Furthermore, the range of an operating frequency in a high frequency band is from about 1694 MHz to about 2185 MHz based on a reflection loss −6 dB indicated by the dotted lines 302, and includes 1710 MHz to 2170 MHz, that is, the frequency section of DCS, PCS and W2100.

In a metal body antenna having loop type radiation elements according to another embodiment of the present invention, as in embodiments of FIGS. 4 and 5, the loop type radiation element can be reduced in size and may be disposed at a specific location between the end part of a bezel and connection points P1 and P2.

Figure 4A:
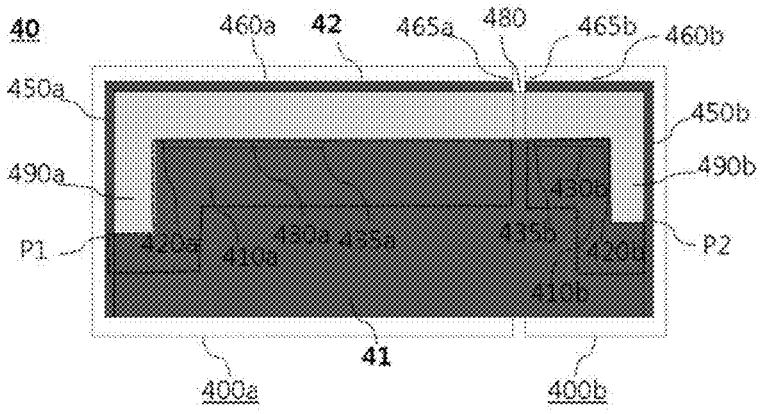
FIG. 4*a* is a case where the radiation element connected to the feeding power port is linear and reduced in size in FIG. 2 and is a detailed plan view showing an enlarged structure of the metal body antenna having loop type radiation elements.
Figure 4B:
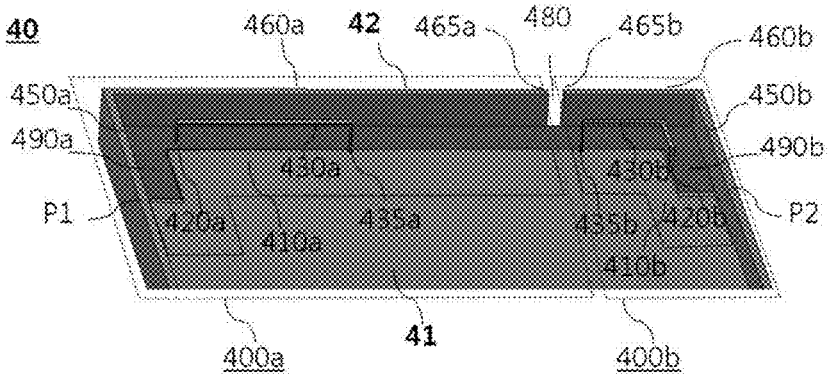
FIG. 4*b* is a case where the radiation element connected to the feeding power port is linear and reduced in size in FIG. 2 and is a detailed perspective view showing an enlarged structure of the metal body antenna having loop type radiation elements.

FIGS. 4*a* and 4*b* are diagrams showing the structure of a metal body antenna having loop type radiation elements according to another embodiment of the present invention. FIG. 4*a* is a plan view showing a detailed and enlarged structure of the metal body antenna in which the end part 435*a* of a first radiation element 430*a* is located in the middle between a first connection point P1 and the end part 465*a* of a first bezel unit 460*a*. FIG. 4*b* is a perspective view showing a detailed and enlarged structure of the metal body antenna having small-sized loop type radiation elements in which the end part 435*a* of the first radiation element 430*a* is located in the middle between the first connection point P1 and the end part 465*a* of the first bezel unit 460*a*.

The structure of FIGS. 4*a* and 4*b* is a structure for reducing the size of an antenna unit by securing a space within the housing unit 40, that is, by securing a space on which other elements and parts for a terminal are to be mounted.

In the metal body antenna having loop type radiation elements of FIGS. 4*a* and 4*b* according to another embodiment of the present invention, the first radiation element 430*a* has a small-sized linear structure. The first and the second side bezel units 450*a* and 450*b* of first and second antenna units 400*a* and 400*b* transfer electromagnetic signals, transferred by first and second connection points P1 and P2, to the first and the second bezel units 460*a* and 460*b* of an upper frame bezel unit 42 that surrounds edge parts in the upper outermost part of a rectangular ground 41.

Accordingly, the first radiation element 430*a* may be disposed at a specific location within the space between the first connection point P1 and the end part 465*a* of the first bezel unit 460*a*.

An operating principle of the metal body antenna having loop type radiation elements using the small-sized radiation elements shown in FIGS. 4*a* and 4*b* is the same as that of the antenna using the linear radiation elements shown in FIG. 3*a*.

Figure 4C:
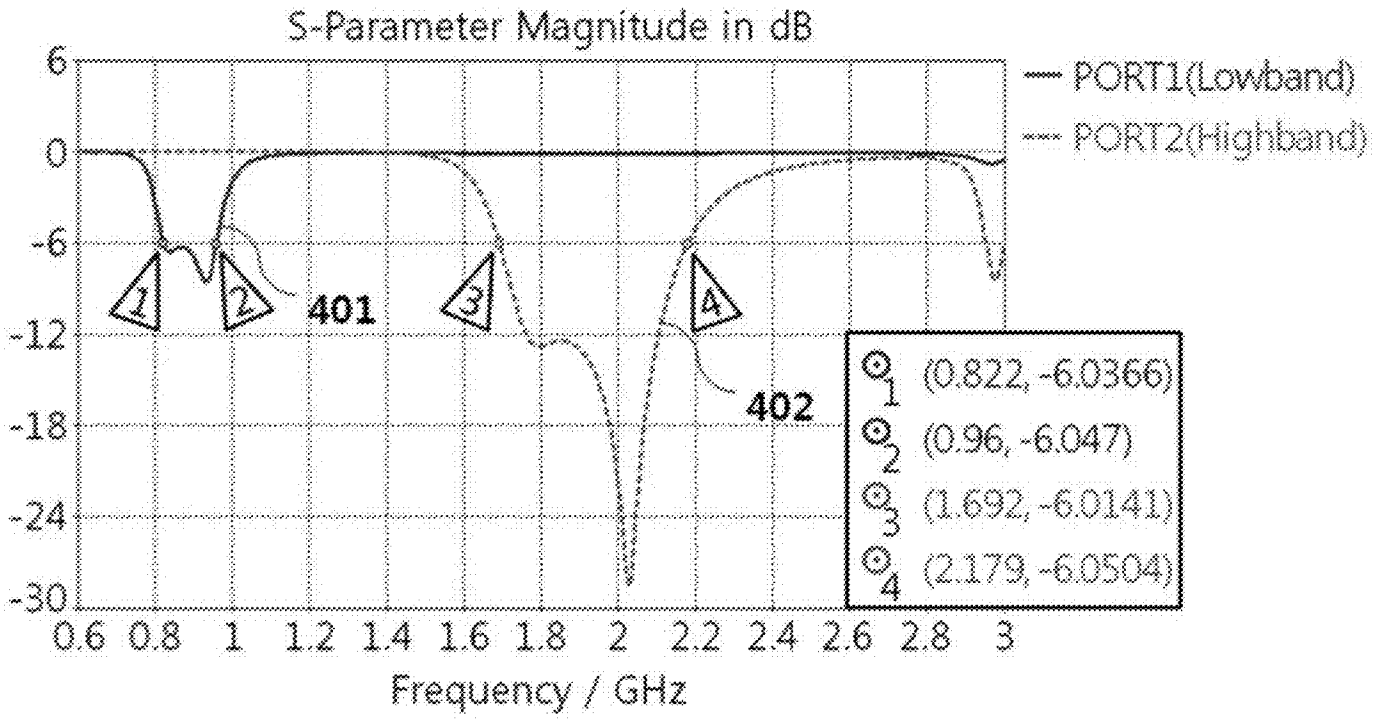
FIG. 4*c* is a case where the radiation element connected to the feeding power port is linear and reduced in size in FIGS. 4*a* and 4*b* and shows a reflection loss of the metal body antenna.

FIG. 4*c* is a diagram showing a reflection loss of the metal body antenna having loop type radiation elements using the small-sized radiation elements shown in FIGS. 4*a* and 4*b*.

Referring to FIG. 4*c*, the range of an operating frequency in a low frequency band is from about 822 MHz to about 960 MHz based on a reflection loss −6 dB indicated by a solid line 401, and includes 824 MHz to 960 MHz, that is, the frequency section of GSM850 and EGSM. The range of an operating frequency in a high frequency band is from about 1692 MHz to about 2179 MHz based on a reflection loss −6 dB indicated by dotted lines 402, and includes 1710 MHz to 2170 MHz, that is, the frequency section of DCS, PCS or W2100.

Figure 5A:
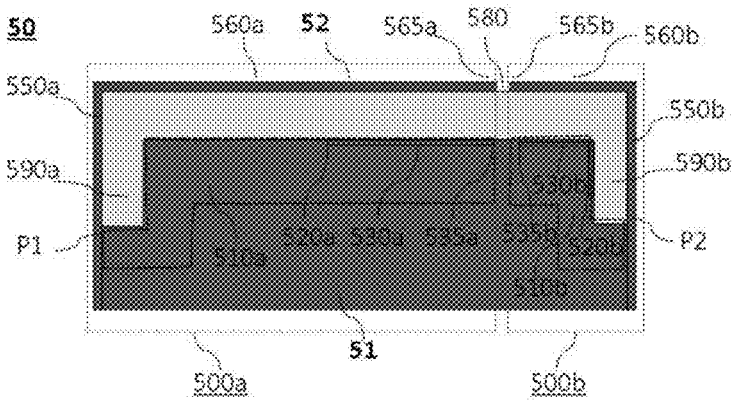
FIG. 5*a* is a case where the radiation element connected to the feeding power port is linear and reduced in size in FIG. 2 and is a detailed plan view showing an enlarged structure of the metal body antenna having loop type radiation elements.
Figure 5B:
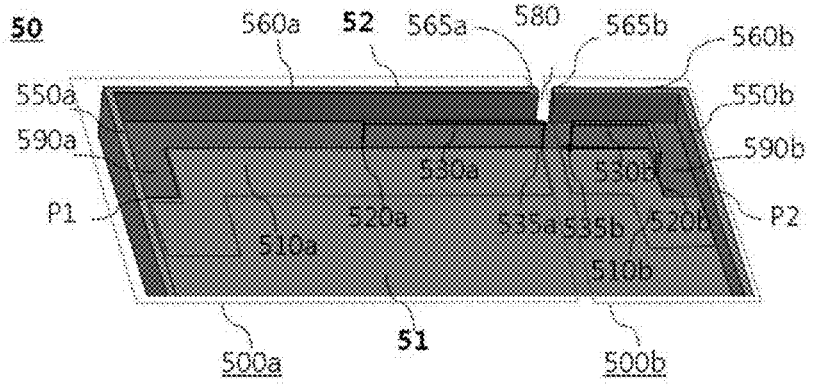
FIG. 5*b* is a case where the radiation element connected to the feeding power port is linear and reduced in size in FIG. 2 and is a detailed perspective view showing an enlarged structure of the metal body antenna having loop type radiation elements.

FIGS. 5*a* and 5*b* are diagrams showing the structure of a metal body antenna having loop type radiation elements according to yet another embodiment of the present invention. FIG. 5*a* is a plan view showing a detailed and enlarged structure of a metal body antenna having small-sized loop type radiation elements in which the first feeding power port 520*a* of a first radiation element 530*a* is located in the middle between a first connection point P1 and the end part 565*a* of a first bezel unit 560*a*. FIG. 5*b* is a perspective view showing a detailed and enlarged structure of the metal body antenna having small-sized loop type radiation elements in which the first feeding power port 520*a* of the first radiation element 530*a* is located in the middle between the first connection point P1 and the end part 565*a* of the first bezel unit 560*a*.

In the metal body antenna having loop type radiation elements of FIGS. 5*a* and 5*b* according to yet another embodiment of the present invention, the first radiation element 530*a* has a small-sized linear structure. The first and second side bezel units 550*a* and 550*b* of first and second antenna units 500*a* and 500*b* transfer electromagnetic signals, transferred by the first and the second connection points P1 and P2, to the first and the second bezel units 560*a* and 560*b* of an upper frame bezel unit 52 that surrounds edge parts in the upper outermost part of the rectangular ground 51.

Accordingly, the first radiation element 530*a* may be disposed at a specific location in the space between the first connection point P1 and the end part 565*a* of the first bezel unit 560*a*. The second radiation element 530*b* may be disposed at a specific location in the space between the second connection point P2 and the end part 565*b* of the second bezel unit 560*b*.

An operating principle of the metal body antenna having loop type radiation elements using the small-sized radiation elements shown in FIGS. 5*a* and 5*b* is the same as that of the antenna using the linear radiation element shown in FIG. 3*a*.

Figure 5C:
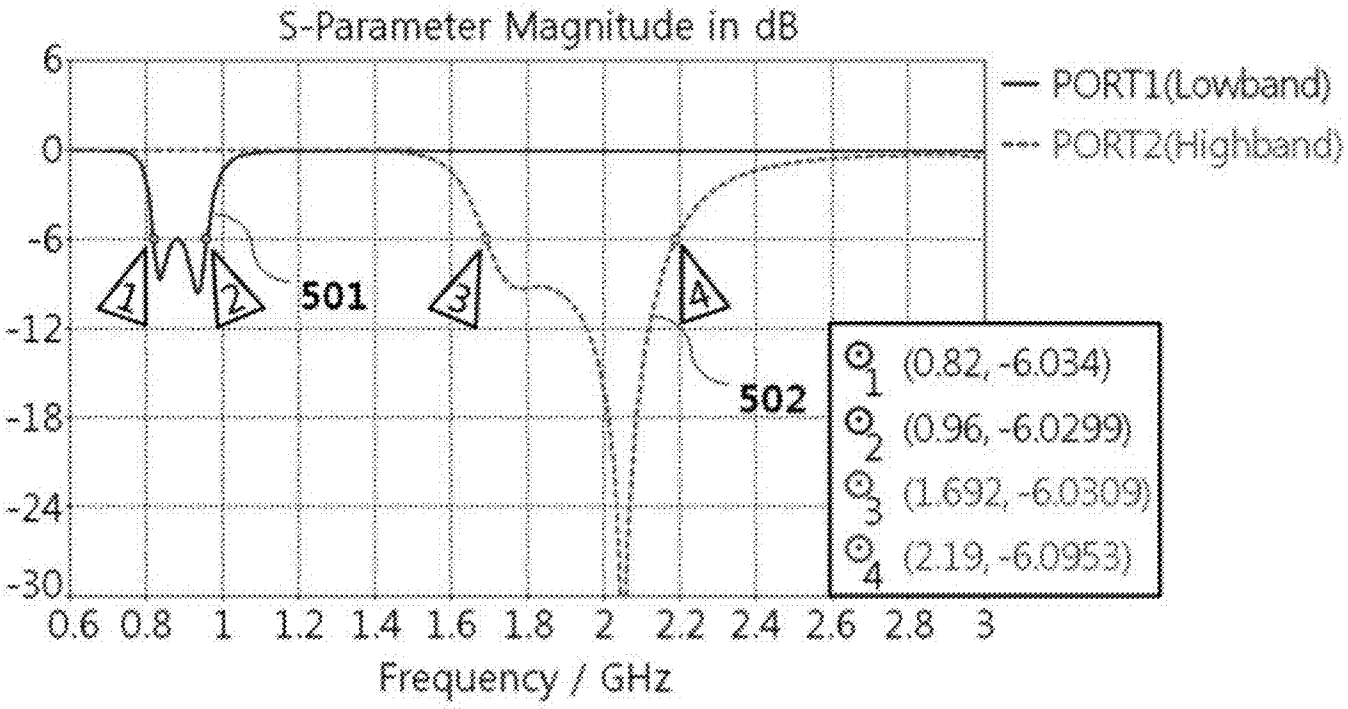
FIG. 5*c* is a case where the radiation element connected to the feeding power port is linear and reduced in size in FIGS. 5*a* and 5*b* and shows a reflection loss of the metal body antenna.

FIG. 5*c* is a diagram showing a reflection loss of the metal body antenna having loop type radiation elements using the small-sized radiation elements shown in FIGS. 5*a* and 5*b*.

Referring to FIG. 5*c*, the range of an operating frequency in a low frequency band is from about 820 MHz to about 960 MHz based on a reflection loss −6 dB indicated by a solid line 501, and includes 824 MHz to 960 MHz, that is, the frequency section of GSM850 and EGSM. The range of an operating frequency in a high frequency band is from about 1692 MHz to about 2190 MHz based on a reflection loss −6 dB indicated by dotted lines 502, and includes 1710 MHz to 2170 MHz, that is, the frequency section of DCS, PCS and W2100.

As described above, the metal body antenna having loop type radiation elements according to an embodiment of the present invention has an advantage in that it shows a wideband characteristic in the Penta Band (i.e., GSM850, EGSM, DCS, PCS, and W2100), that is, a band chiefly used in mobile phones because the metal body antenna has a multi-antenna structure of a wideband using the frame bezel unit and having a small radiation loss.

Furthermore, the metal body antenna having loop type radiation elements according to an embodiment of the present invention has an advantage in that it shows a wideband characteristic in multiple bands because the radiation element supplied with a signal from the feeding power port is not coupled to the frame bezel unit as a radiation element coupled to the ground, but the radiation element supplied with a signal from the feeding power port is coupled to the ground by loop coupling.

Furthermore, the metal body antenna having loop type radiation elements according to an embodiment of the present invention has an advantage in that it shows a wideband characteristic in multiple bands because when an electromagnetic signal is applied to the feeding power port, the radiation element is coupled to the ground by loop coupling to generate an induction current in the ground, electric energy is concentrated on the end part of the upper bezel unit due to a surface current that flows into the frame bezel unit as a radiation element connected to the ground due to an electric current induced into the ground, and magnetic energy is concentrated near the connection point that connects the side bezel unit and the ground.

Furthermore, the metal body antenna having loop type radiation elements according to an embodiment of the present invention has an advantage in that it shows a wideband characteristic in multiple bands because the L-C element is inserted into the feeding power port and perfect impedance matching with the antenna unit is performed in an operating frequency band.

Although the embodiments of the present invention have been described in detail so far, it is evident that the embodiments are only illustrative, but are not limitative. It should be understood that a change of elements to the extent that the change may be equivalently handled without departing from the technical spirit or field of the present invention provided by the attached claims falls within the scope of the present invention.

What is claimed is:

1. A metal body antenna having loop type radiation elements in a housing unit and operating in a wideband in multiple bands, the metal body antenna comprising:

a first antenna unit adapted to comprise:

a first radiation element supplied with an electromagnetic signal from a first feeding power port formed in the housing unit, a ground formed in the housing unit and coupled to the first radiation element by loop coupling to generate an induction current, a connection point connected to the ground, and a frame bezel unit connected to the connection point, wherein the frame bezel unit includes an upper frame bezel unit and a side frame bezel unit, the upper frame bezel unit connected to the side frame bezel unit and having an end part open by a gap; and a second antenna unit adapted to comprise:

a second radiation element supplied with an electromagnetic signal from a second feeding power port formed in the housing unit, a ground formed in the housing unit and coupled to the second radiation element by loop coupling to generate an induction current, a connection point connected to the ground, and a frame bezel unit connected to the connection point, wherein the frame bezel unit includes an upper frame bezel unit and a side frame bezel unit, the upper frame bezel unit connected to the side frame bezel unit and having an end part open by a gap.

2. The metal body antenna of claim 1, wherein the first and second antenna units have an electrical length of a half wavelength, respectively.

3. The metal body antenna of claim 1, wherein the upper frame bezel unit is separated from the ground by a dielectric and surrounds an outermost edge part of the ground.

4. The metal body antenna of claim 1, wherein the frame bezel unit is formed on an outskirt of the housing unit.

5. The metal body antenna of claim 1, wherein the first radiation element and the second radiation element are formed above the ground.

6. The metal body antenna of claim 2, wherein the first radiation element and the second radiation element are formed above the ground.

7. The metal body antenna of claim 3, wherein the first radiation element and the second radiation element are formed above the ground and the dielectric.

8. The metal body antenna of claim 4, wherein the first radiation element and the second radiation element are formed above the ground.

9. The metal body antenna of claim 1, wherein the first radiation element and the second radiation element are each disposed at a specific location above the ground between the end part of the upper frame bezel unit and the connection point.

10. The metal body antenna of claim 2, wherein the first radiation element and the second radiation element are each disposed at a specific location above the ground between the end part of the upper frame bezel unit and the connection point.

11. The metal body antenna of claim 3, wherein the first radiation element and the second radiation element are each disposed at a specific location above the ground between the end part of the upper frame bezel unit and the connection point.

12. The metal body antenna of claim 4, wherein the first radiation element and the second radiation element are each disposed at a specific location above the ground between the end part of the upper frame bezel unit and the connection point.

13. The metal body antenna of claim 1, wherein L-C elements are inserted between the first feeding power port and the first radiation element, and between the second feeding power port and the second radiation element, respectively.

14. The metal body antenna of claim 2, wherein L-C elements are inserted between the first feeding power port and the first radiation element, and between the second feeding power port and the second radiation element, respectively.

15. The metal body antenna of claim 3, wherein L-C elements are inserted between the first feeding power port and the first radiation element, and between the second feeding power port and the second radiation element, respectively.

16. The metal body antenna of claim 4, wherein L-C elements are inserted between the first feeding power port and the first radiation element, and between the second feeding power port and the second radiation element, respectively.

17. The metal body antenna of claim 1, wherein the first and the second radiation elements are formed on both sides of the ground based on the gap.

18. The metal body antenna of claim 2, wherein the first and the second radiation elements are formed on both sides of the ground based on the gap.

19. The metal body antenna of claim 3, wherein the first and the second radiation elements are formed on both sides of the ground based on the gap.

20. The metal body antenna of claim 4, wherein the first and the second radiation elements are formed on both sides of the ground based on the gap.

* * * * *